US010172428B2

(12) United States Patent
Kukathas

(10) Patent No.: US 10,172,428 B2
(45) Date of Patent: Jan. 8, 2019

(54) ADJUSTABLE COMBINATION CARRYING AND CLOSURE STRAP SYSTEM FOR A BAG

(71) Applicant: RYU Apparel Inc., Vancouver (CA)

(72) Inventor: Nathan Kukathas, Vancouver (CA)

( * ) Notice: Subject to any disclaimer, the term of this patent is extended or adjusted under 35 U.S.C. 154(b) by 0 days.

(21) Appl. No.: 15/359,519

(22) Filed: Nov. 22, 2016

(65) Prior Publication Data

US 2017/0143085 A1 May 25, 2017

Related U.S. Application Data

(60) Provisional application No. 62/258,662, filed on Nov. 23, 2015.

(51) Int. Cl.

| | |
|---|---|
| ***A45C 9/00*** | (2006.01) |
| ***A45C 3/00*** | (2006.01) |
| ***A45C 13/10*** | (2006.01) |
| ***A45C 13/30*** | (2006.01) |
| ***A45F 3/02*** | (2006.01) |

(52) U.S. Cl.

CPC ..... *A45C 9/00* (2013.01); *A45C 3/00* (2013.01); *A45C 13/10* (2013.01); *A45C 13/30* (2013.01); *A45F 3/02* (2013.01); *A45C 2009/007* (2013.01)

(58) Field of Classification Search

CPC ..... A45F 3/02; A45F 3/14; A45F 2003/14; A45C 13/26; A45C 13/30; A45C 3/00

USPC ..... 224/310, 924, 601, 578, 607, 610, 612

See application file for complete search history.

(56) References Cited

U.S. PATENT DOCUMENTS

| | | | | |
|---|---|---|---|---|
| 4,153,092 A * | 5/1979 | Haslam | A45C 3/00 150/108 |
| 7,628,187 B2 * | 12/2009 | Mittelstaedt | A45C 3/08 150/105 |
| 8,109,306 B2 * | 2/2012 | Paulk | A45C 13/00 150/114 |

* cited by examiner

*Primary Examiner* — Adam Waggenspack

(74) *Attorney, Agent, or Firm* — Snell & Wilmer LLP

(57) ABSTRACT

A way to provide an adjustable strap system for both carrying and closing a bag.

13 Claims, 19 Drawing Sheets

ADJUSTABLE COMBINATION CARRYING AND CLOSURE STRAP SYSTEM FOR A BAG

CROSS REFERENCE TO RELATED APPLICATIONS

This application claims priority from U.S. Provisional Patent Application Ser. No. 62/258,662 filed on Nov. 23, 2015, entitled ADJUSTABLE COMBINATION CARRYING AND CLOSURE STRAP SYSTEM FOR A BAG, which is expressly incorporated by reference herein to the fullest extent permitted by law.

BACKGROUND OF THE INVENTION

1. Field of the Invention

The present invention relates to strap systems used to carry and/or close a bag.

2. Description of Related Art

Bags, particularly soft-sided bags such as duffle bags, are convenient for holding items, but can be cumbersome to carry, and can be prone to allow items to shift within or fall out.

Straps can provide a handle for carrying a bag and can also allow a bag to be suspended from a shoulder or other body part or object. Straps can also help to close the bag, keep it closed, and retain contained items in place.

Because people, their items, and their usages vary, it is useful if straps can adjust accordingly.

SUMMARY OF THE INVENTION

The present invention is directed to this need, providing an adjustable strap system for both carrying and closing a bag.

According to one aspect of the present invention, there is provided an apparatus, usable as a bag, comprising: a sidewall having opposing edges that are operable to be releasably fastened together by first complementary couplers when adjacent, to form an open-ended enclosure, opposing endwalls operable to be fastened to the sidewall to form a closed-ended enclosure, wherein the sidewall further has respective bottom flap portions extendable beyond the opposing endwalls, and a strap extendable between the respective bottom flap portions such that when the apparatus is suspended from the strap, the strap is operable to draw the respective bottom flap portions taut against the opposing endwalls.

The respective bottom flap portions may be fixed to the adjacent respective endwalls. The respective bottom flap portions may be fixed proximate their centre portion to the adjacent respective endwalls.

The sidewall may further have respective top flap portions, proximate the opposing edges, that extend beyond the respective opposing endwalls to provide additional slack at the opposing edges to enable the apparatus to be opened wider than would be otherwise possible.

Each of the respective bottom flap portions may have a respective eye, and the apparatus may further include respective tie-downs that extend between respective ends of adjacent top flap portions and bottom flap portions, passing through respective eyes of respective bottom flap portions, such that when the apparatus is suspended from the strap and the respective bottom flap portions are drawn taut against the respective endwalls, the respective tie-downs are drawn through the respective eyes, thereby drawing the respective top flap portions between the respective opposing endwalls and the respective bottom flap portions.

The respective eyes may be affixed to the respective bottom flap portions at a junction where the respective opposing endwalls close the respective ends of the sidewalls. The respective eyes may be affixed by a tether operable to retractably extend through a gap between a centre portion of the respective bottom flap portions and the adjacent endwalls.

Alternatively, each of the respective bottom flap portions may have a respective eye, and the apparatus may further include respective tie-downs that extend between respective ends of adjacent top flap portions and a portion of the strap adjacent the respective bottom flap portion, passing through respective eyes of respective bottom flap portions, such that when the apparatus is suspended from the strap and the respective bottom flap portions are drawn taut against the respective endwalls, the respective tie-downs are drawn through the respective eyes, thereby drawing the respective top flap portions between the respective opposing endwalls and the respective bottom flap portions.

The apparatus may further include a cover adapted to at least partially cover the first complementary coupler. The cover may be permanently fastened to the sidewall proximate to one of the opposing edges and releasably fastened to the sidewall proximate to the other one of the opposing edges with a second complementary coupler. The second complementary coupler may have more than one fastening position, to accommodate varying degrees of fullness of the bag apparatus.

The strap may be formed as two sections. Each of the respective two sections of the strap may be approximately the length of the apparatus and have a free end and a fixed end affixed to one of the respective bottom flap portions. The free end of one of the respective two sections of the strap may have a receptacle for slidably receiving the free end of the other one of the respective two sections of the strap, which received free end may have a termination adapted to resist removal of the received free end from the receptacle, whereby the two respective sections of the strap function as a complete strap from which to suspend the apparatus. At least one of the respective two sections of the strap may be doubled. The termination may be part of a third complementary coupler to secure the other one of the two respective sections of the strap to both of the bottom flap portions, thereby further cinching the apparatus and converting the strap into a reinforced handle configuration.

Further aspects and advantages of the present invention will become apparent upon considering the following figures and description.

DESCRIPTION OF THE INVENTION

The invention will be more fully illustrated by the following detailed description of non-limiting specific embodiments in conjunction with the accompanying drawing figures. In the figures, similar elements and/or features may have the same reference label. Further, various elements of the same type may be distinguished by following the reference label with a second label that distinguishes among the similar elements. If only the first reference label is identified in a particular passage of the detailed description, then that passage describes any one of the similar elements having the same first reference label irrespective of the second reference label.

DETAILED DESCRIPTION OF SPECIFIC EMBODIMENTS

(a) Structure of Specific Embodiments

Figure 1:
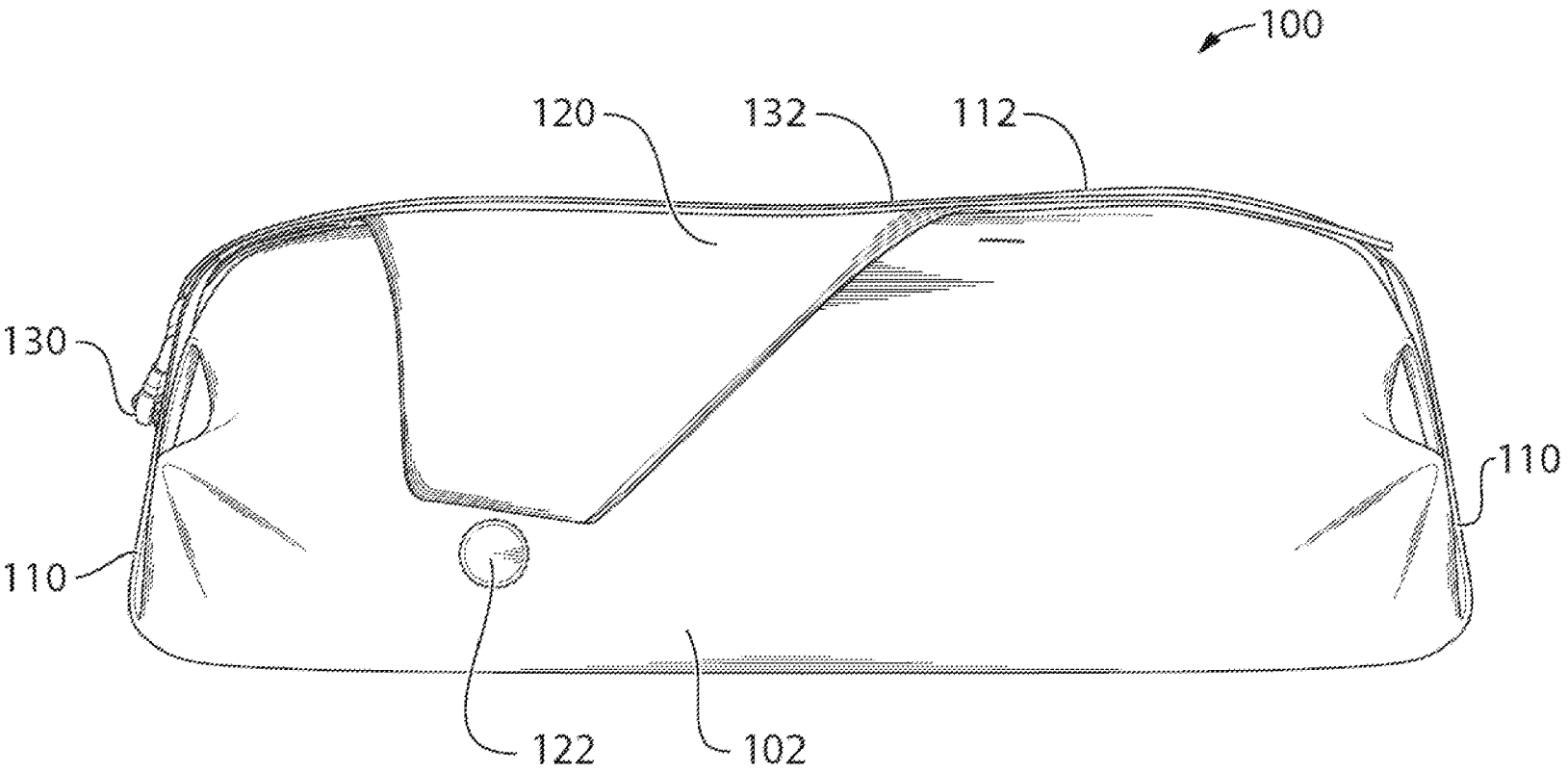
FIG. 1 is a front elevation view of one embodiment of a bag having an adjustable combination carrying and closure strap system in accordance with aspects of the present invention.
Figure 2:
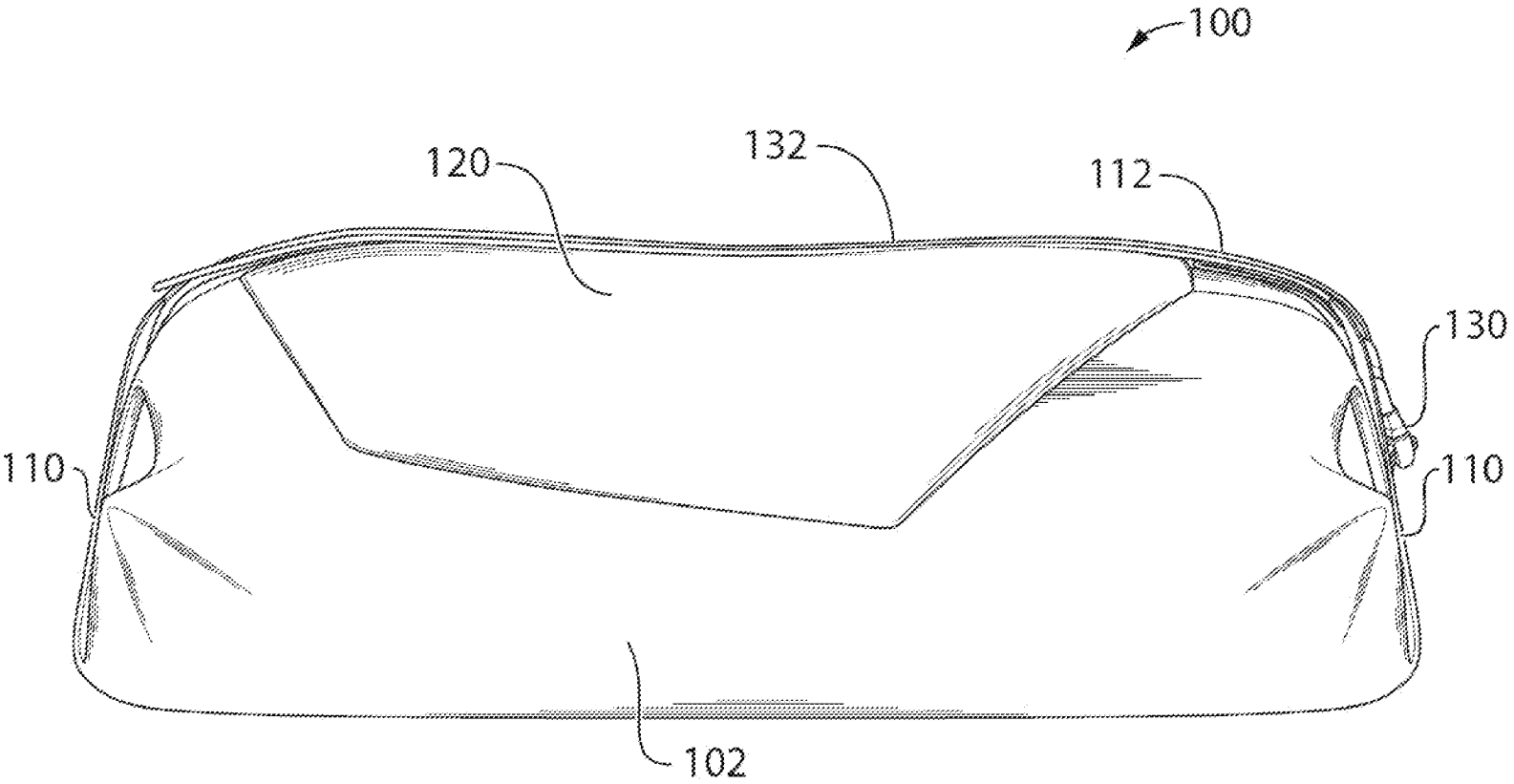
FIG. 2 is a rear elevation view of the bag of FIG. 1.
Figure 3:
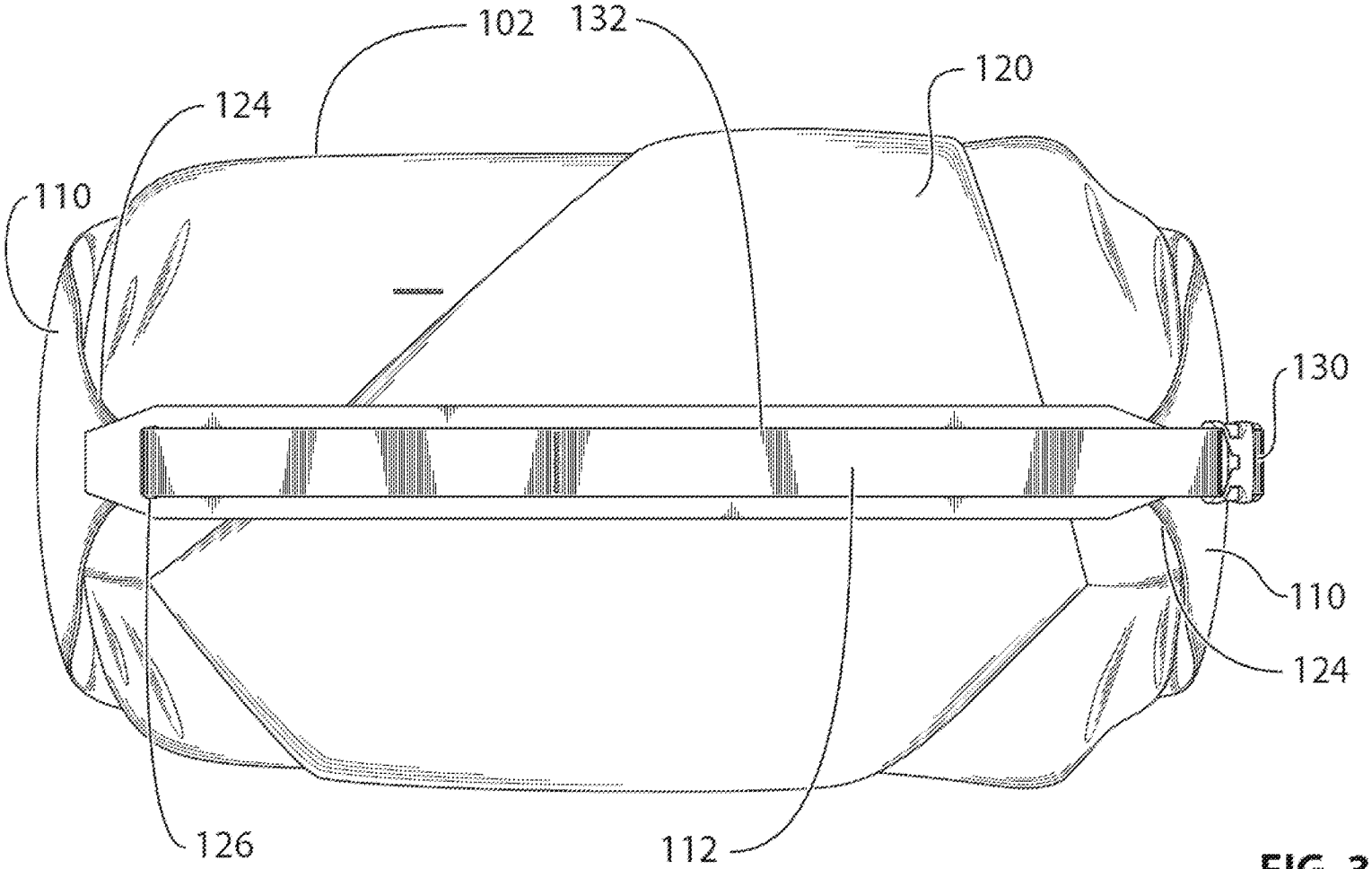
FIG. 3 is a top plan view of the bag of FIG. 1.
Figure 4:
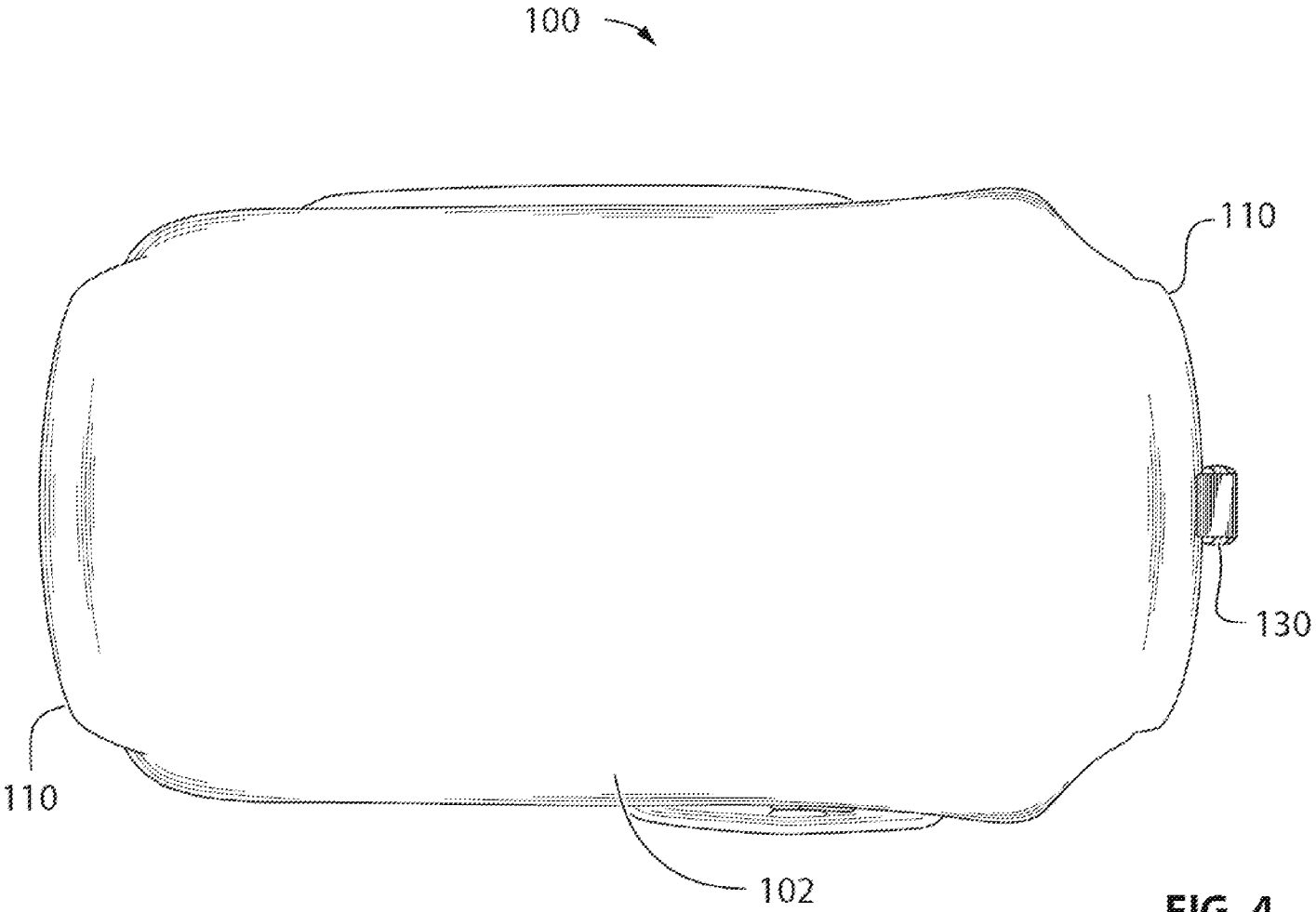
FIG. 4 is a bottom plan view of the bag of FIG. 1.
Figure 5:
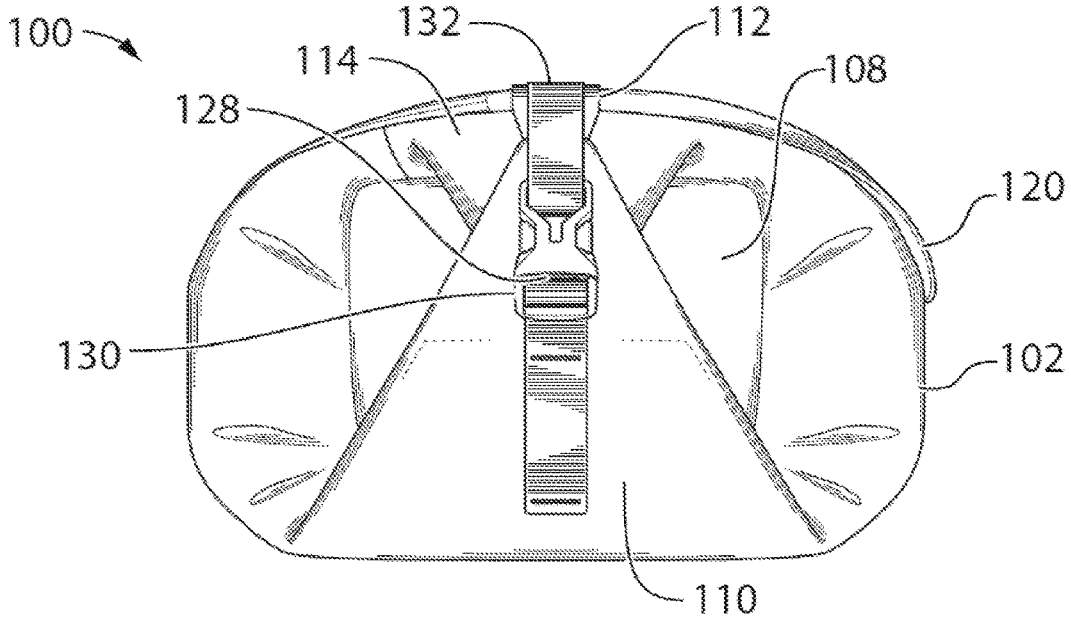
FIG. 5 is a left elevation view of the bag of FIG. 1.
Figure 6:
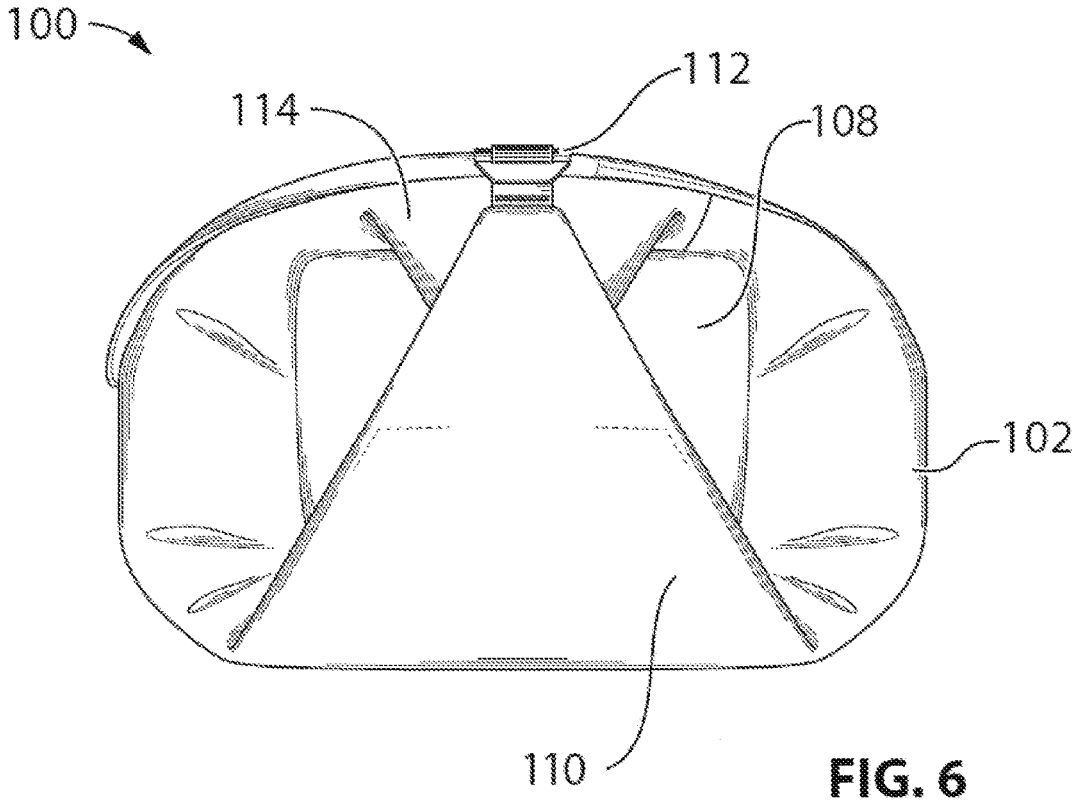
FIG. 6 is a right elevation view of the bag of FIG. 1.
Figure 7:
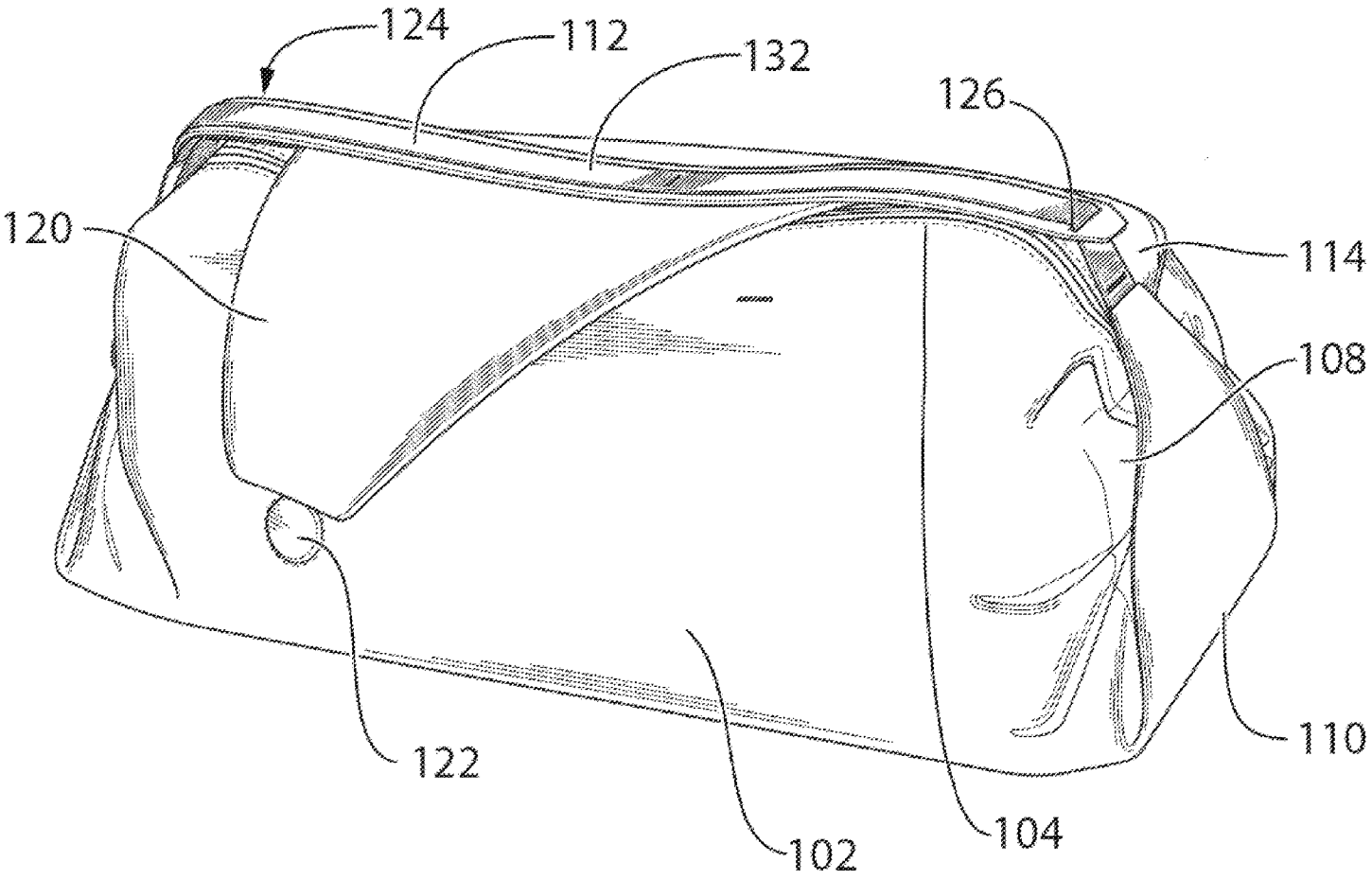
FIG. 7 is a top, front, right oblique view of the bag of FIG. 1.
Figure 8:
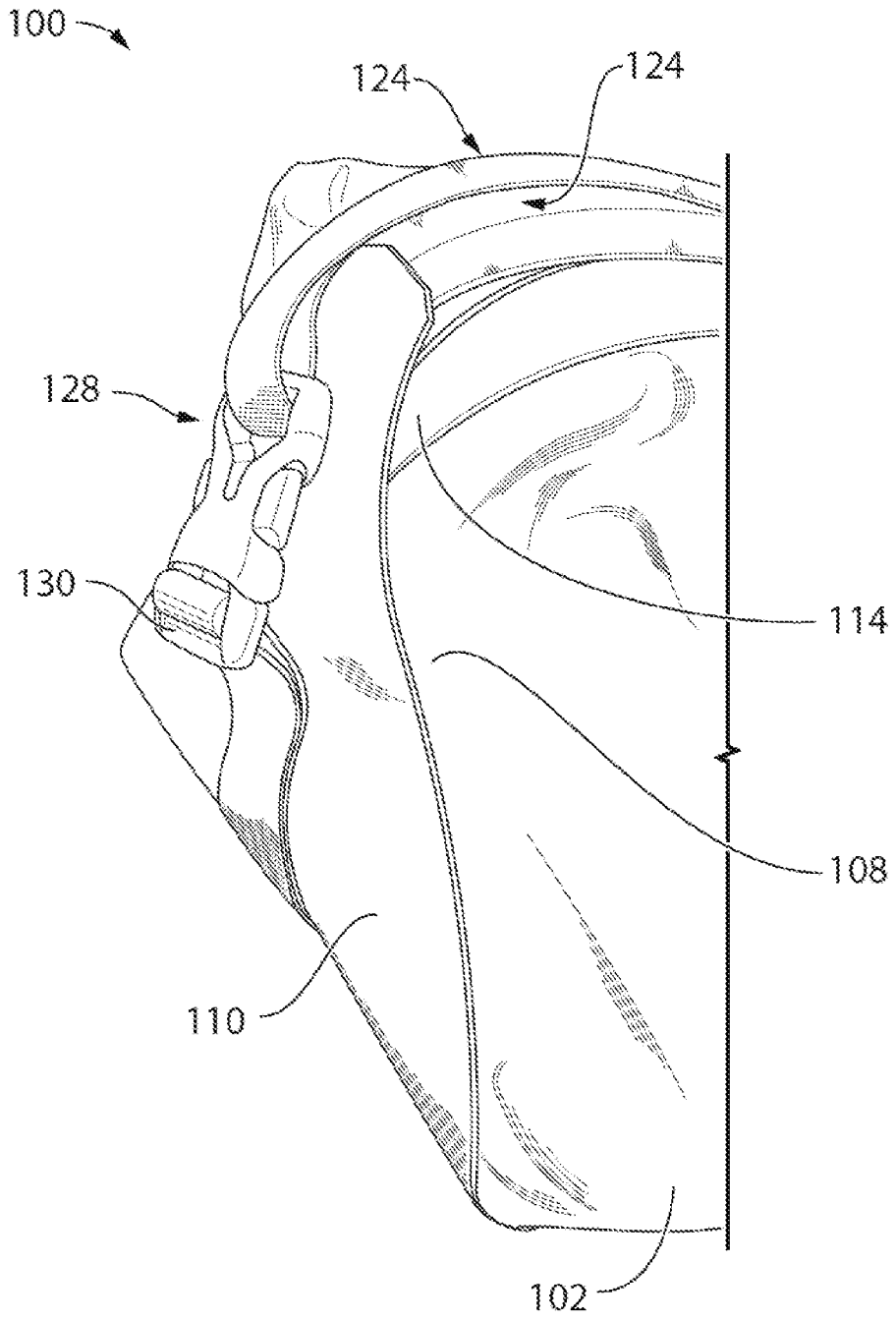
FIG. 8 is a top, front, left oblique view of the bag of FIG. 1, detailing the left side of the bag.
Figure 9:
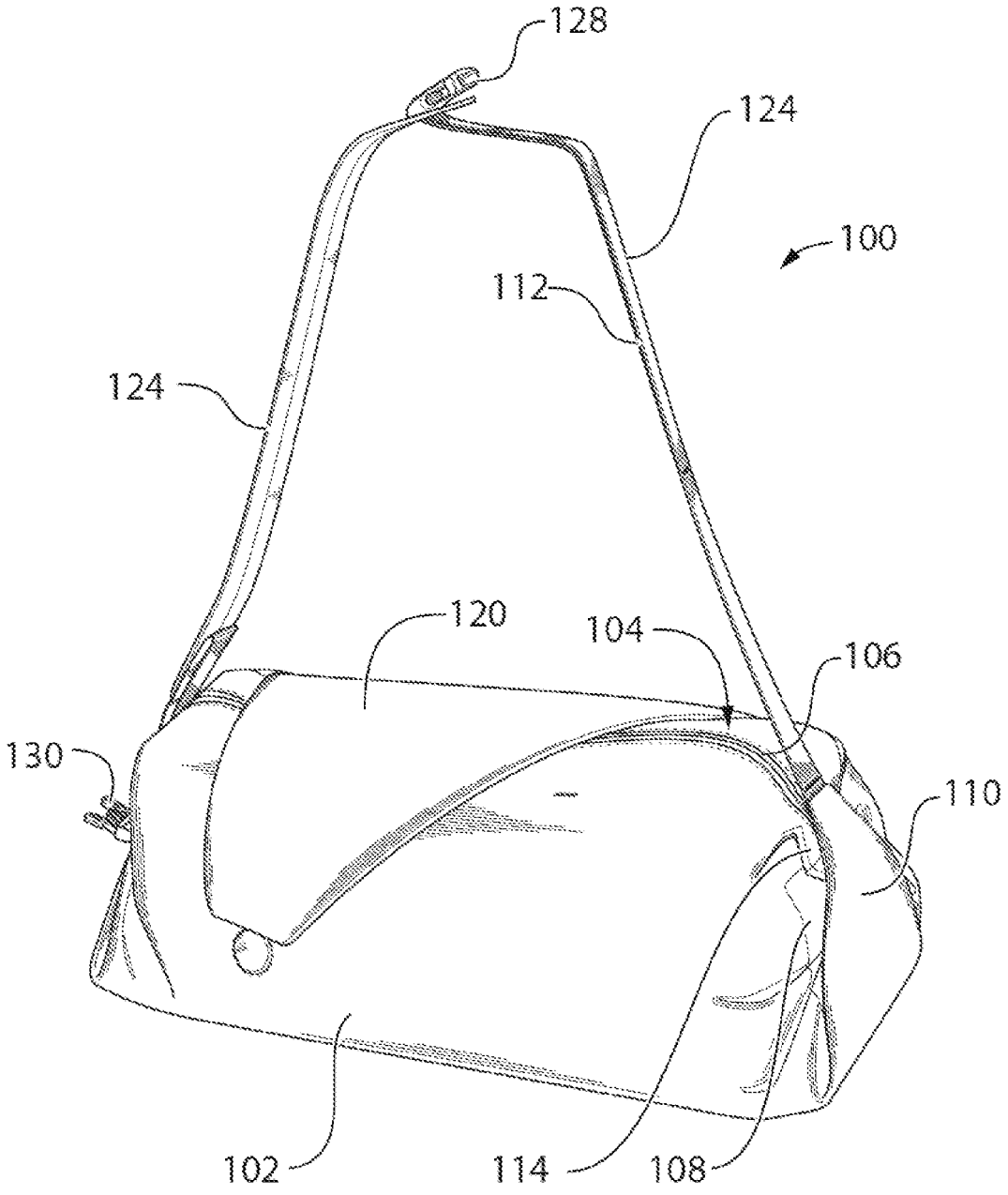
FIG. 9 is a top, front, right oblique view of the bag of FIG. 1, with the strap extended.
Figure 10:
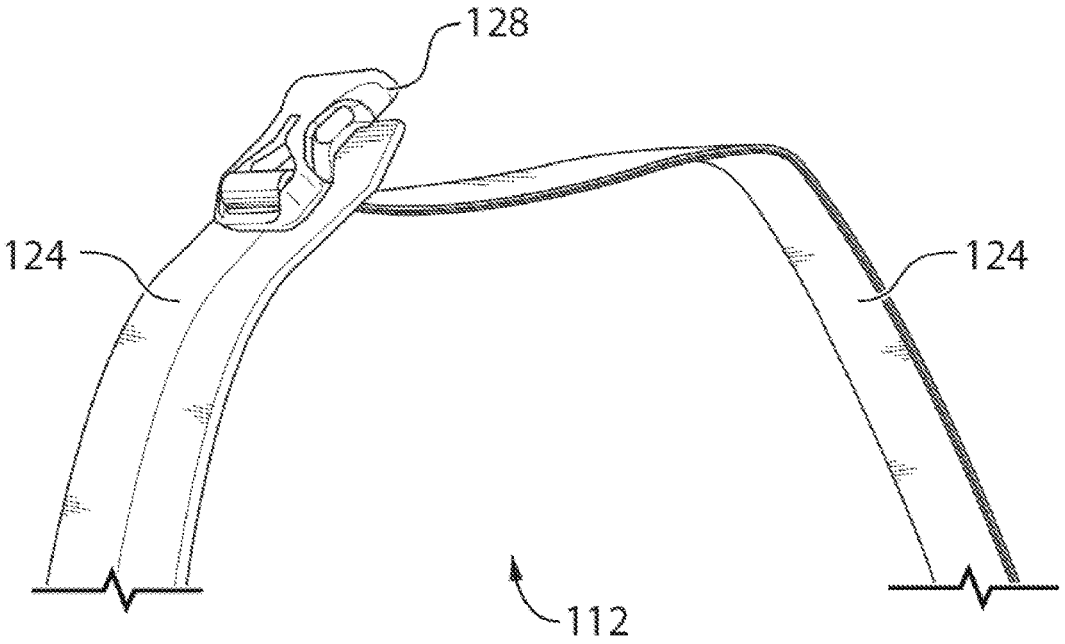
FIG. 10 is a top, front, left oblique view of the bag of FIG. 1, detailing the portion of the extended strap where its two sections meet, as illustrated tautly.
Figure 11:
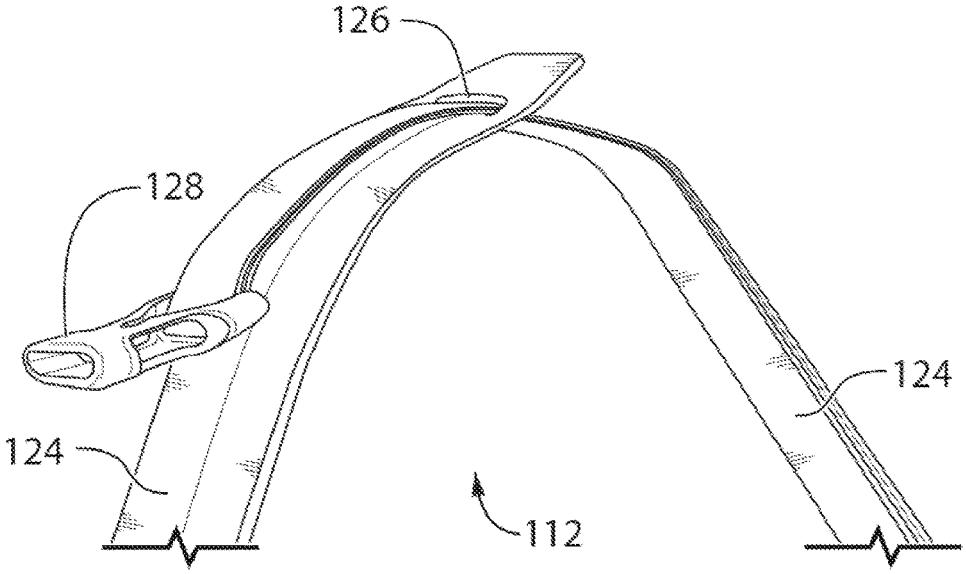
FIG. 11 is a top, front, left oblique view of the bag of FIG. 1, detailing the portion of the extended strap where its two sections meet, as illustrated slackly.
Figure 12:
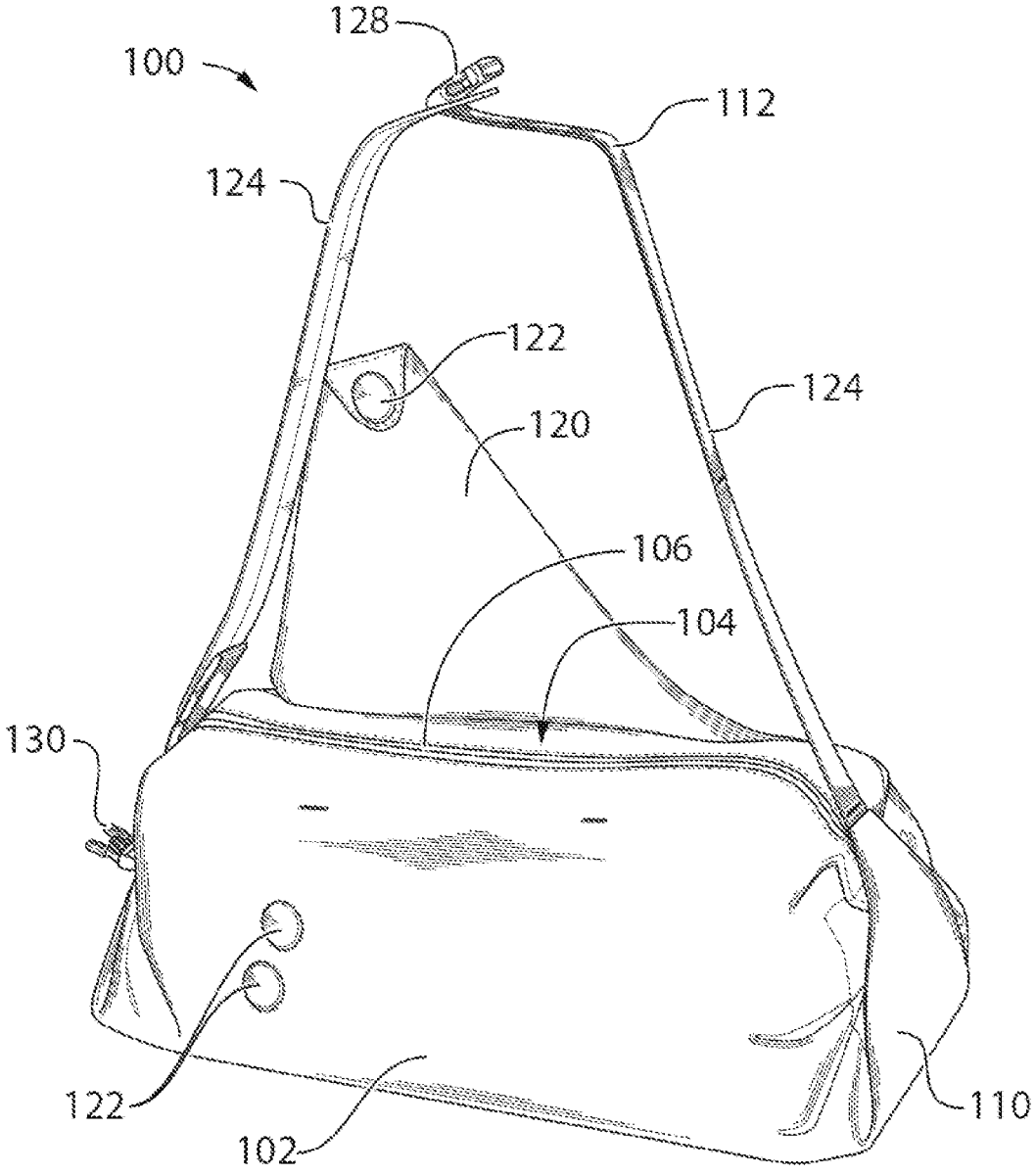
FIG. 12 is a top, front, right oblique view of the bag of FIG. 1, with the strap extended and a cover opened to reveal a zippered portion of a sidewall.
Figure 13:
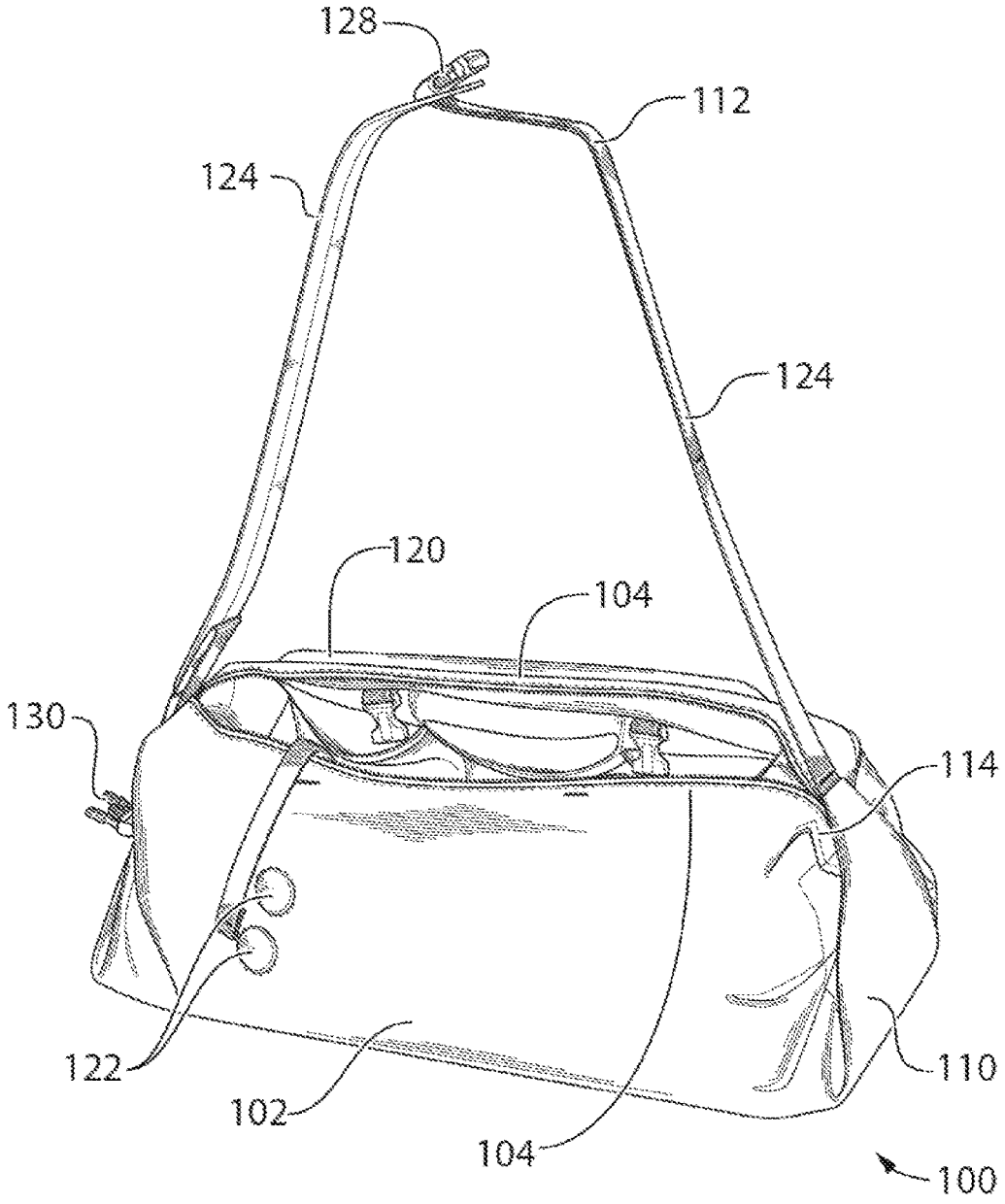
FIG. 13 is a top, front, right oblique view of the bag of FIG. 1, with the strap extended, the cover opened, and a the zippered portion of the sidewall opened.
Figure 14:
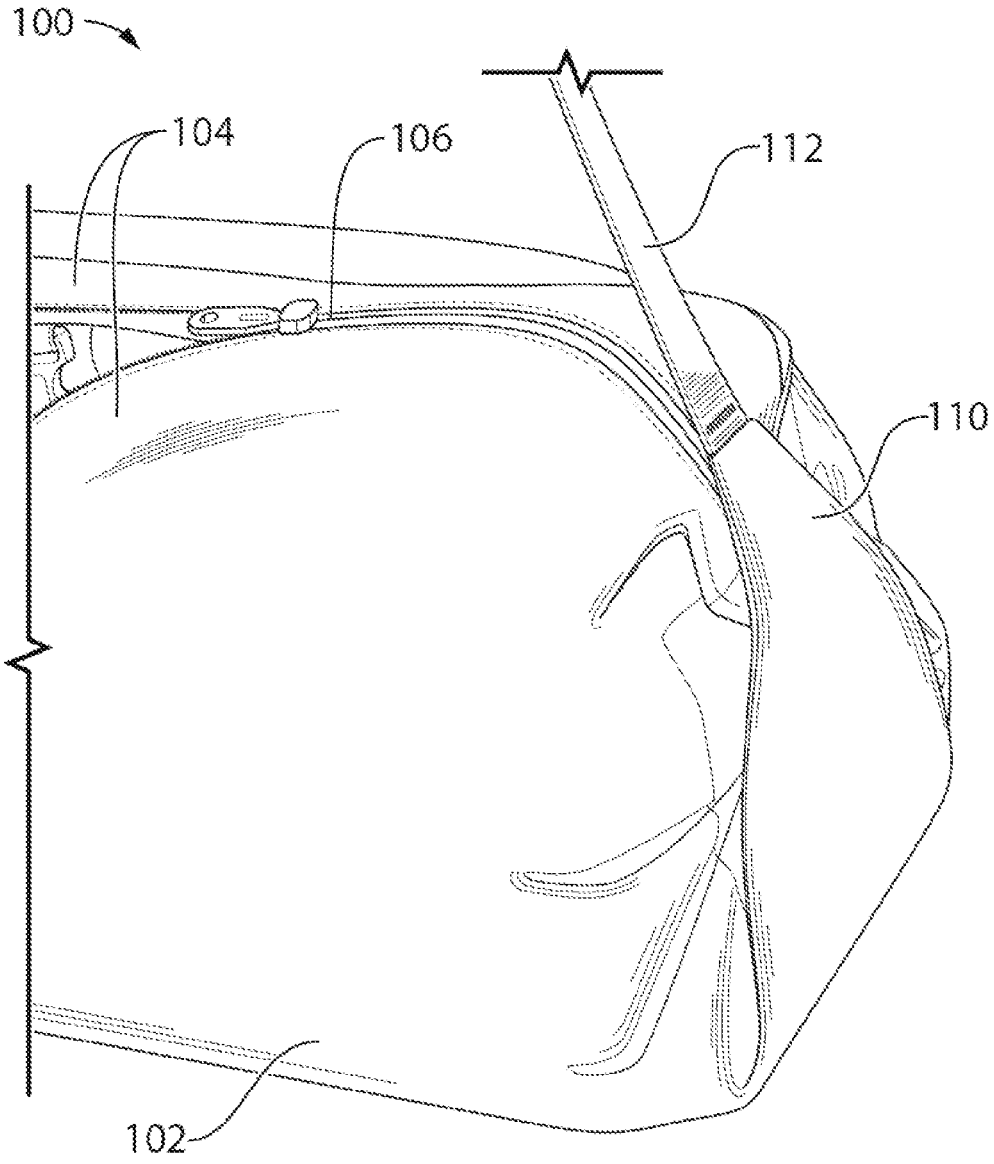
FIG. 14 is a top, front, right oblique view of the bag of FIG. 1, detailing the right side of the bag with a bottom flap portion held taut by the strap.
Figure 15:
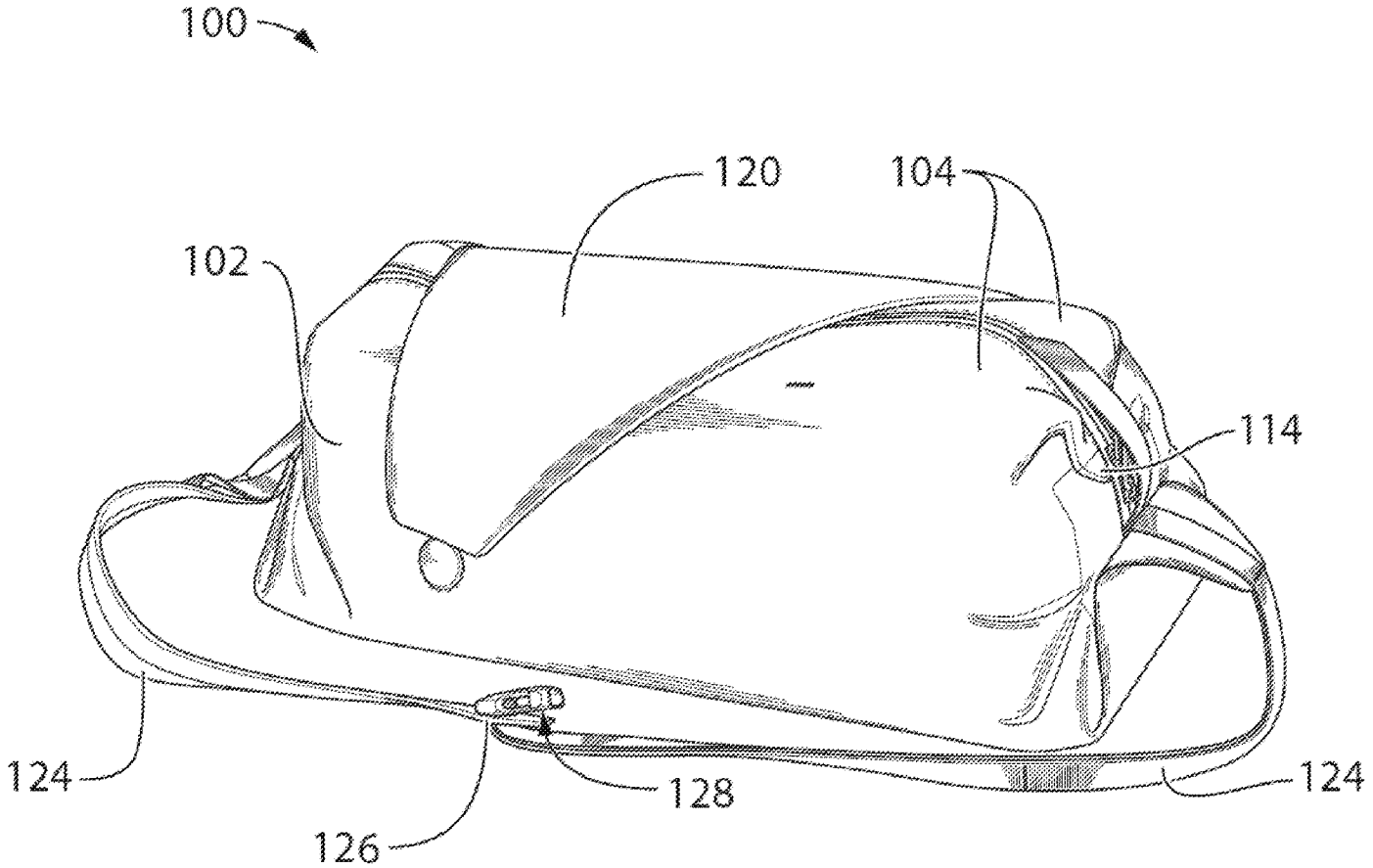
FIG. 15 is a top, front, right oblique view of the bag of FIG. 1, showing the right side of the bag with the bottom flap portion relaxed and a top flap portion held taut by a tie-down.
Figure 16:
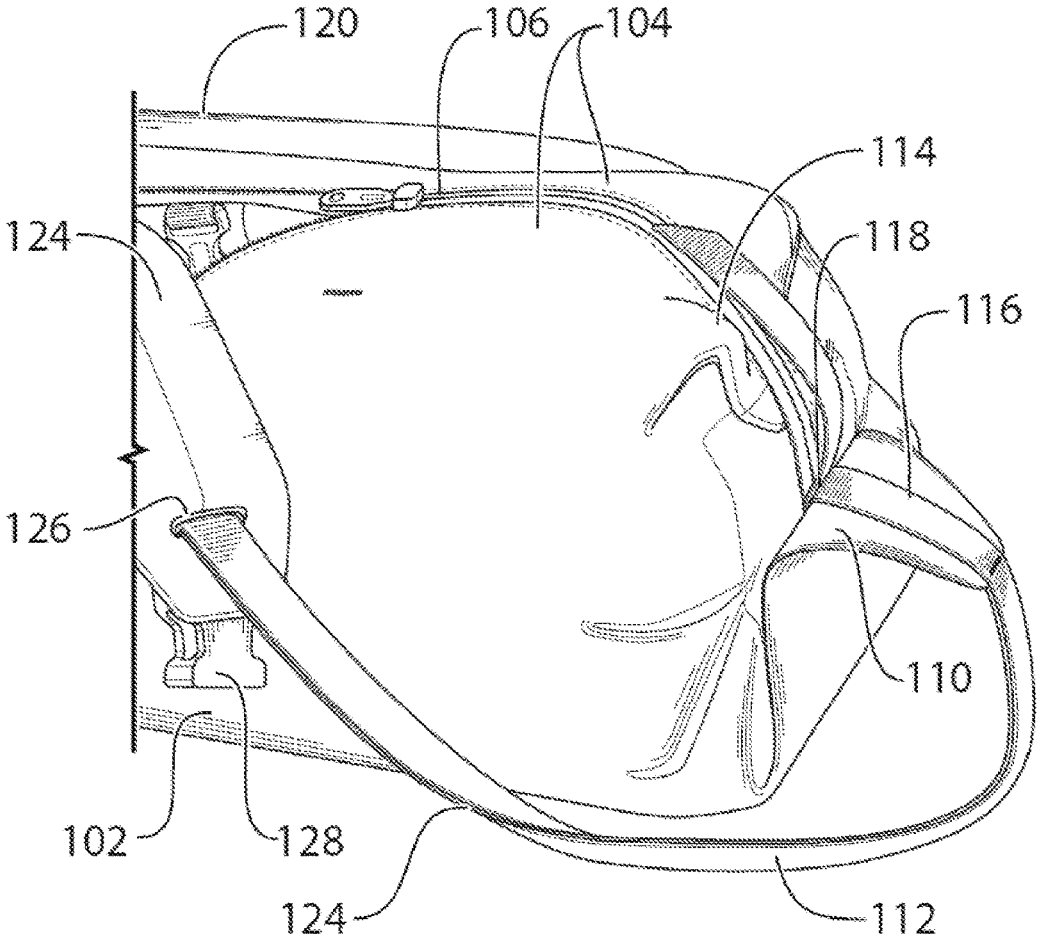
FIG. 16 is a top, front, right oblique view of the bag of FIG. 1, detailing the right side of the bag with the bottom flap portion relaxed and the top flap portion held taut by the tie-down.
Figure 17:
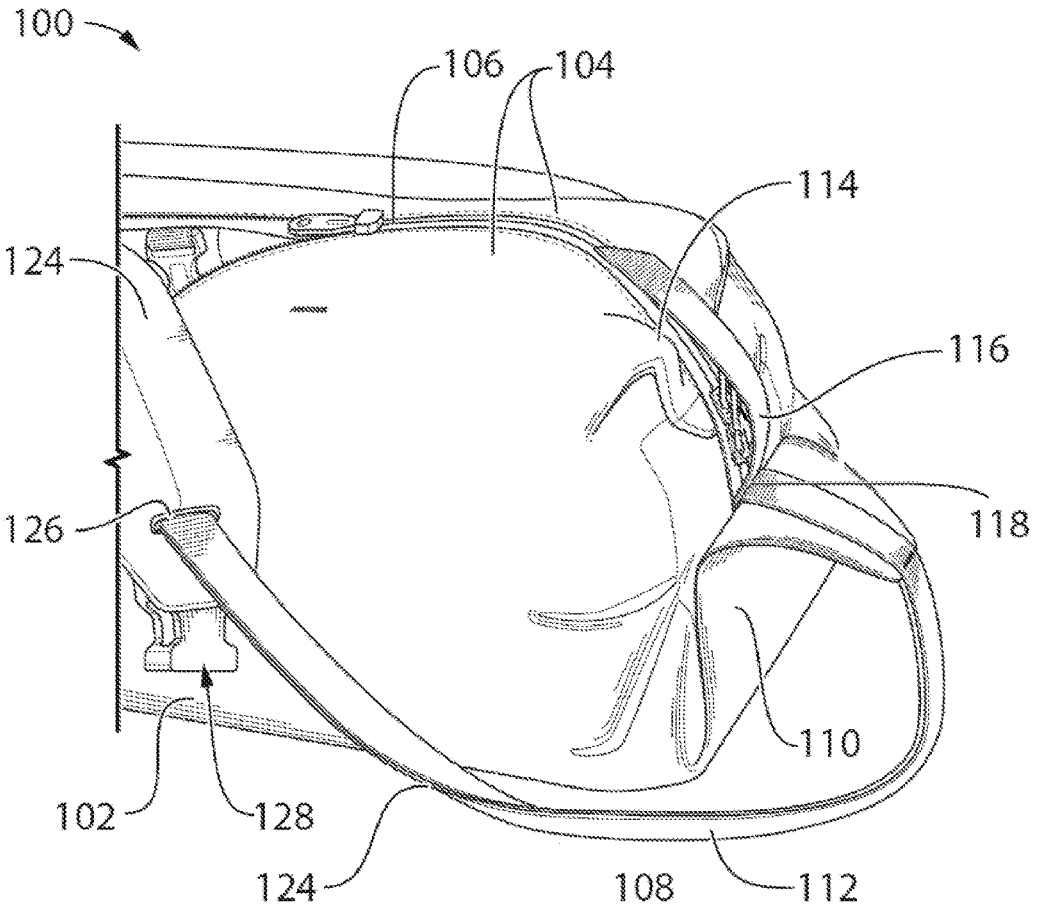
FIG. 17 is a top, front, right oblique view of the bag of FIG. 1, detailing the right side of the bag with the bottom flap portion relaxed and the top flap portion relaxed.

The figures show a bag 100 according to embodiments of the present invention. The bag 100 may be a soft bag, for example a duffle bag, as illustrated.

Table of Parts

| # | Name | Name | # |
|---|---|---|---|
| 100 | bag | bag | 100 |
| 102 | sidewall | bottom flap portions | 110 |
| 104 | opposing edges | cover | 120 |
| 106 | first complementary couplers | endwalls | 108 |
| 108 | endwalls | eyes | 118 |
| 110 | bottom flap portions | first complementary couplers | 106 |
| 112 | strap | handle | 132 |
| 114 | top flap portions | opposing edges | 104 |
| 116 | tie-downs | receptacle | 126 |
| 118 | eyes | second complementary coupler | 122 |
| 120 | cover | sections | 124 |
| 122 | second complementary coupler | sidewall | 102 |
| 124 | sections | strap | 112 |
| 126 | receptacle | termination | 128 |
| 128 | terminationn | third complementary coupler | 130 |
| 130 | third complementary coupler | tie-downs | 116 |
| 132 | handle | top flap portions | 114 |

The bag 100 may have a sidewall 102 formed from one or more panels, having one or more layers. The sidewall 102 may have two opposing edges 104 that when adjacent can be releasably fastened together, for example with a first complementary coupler 106, for example with a zipper, to form an open-ended enclosure. The bag 100 may further have opposing endwalls 108 that may be fastened to the sidewall 102 to form a closed-ended enclosure. The enclosure of the bag 100 may be subdivided or otherwise arranged in various manners.

As illustrated, respective bottom flap portions 110 of the sidewall 102 may extend beyond the respective endwalls 108. A strap 112 may extend between the respective bottom flap portions 110, such that when the bag 100 is suspended from the strap 112, the strap 112 draws the bottom flap portions 110 taut against the endwalls 108. As illustrated, the bottom flap portions 110 may be further fixed, for example proximate their centre portion, for example by stitching, for example to the adjacent endwalls 108.

As illustrated, respective top flap portions 114 of the sidewall 102 proximate the edges 104 may extend beyond the respective endwalls 108 to provide additional slack at the opposing edges 104 to enable the bag 100 to be opened wider than would be otherwise possible.

Respective tie-downs 116 may extend between the ends of adjacent top flap portions 114 and bottom flap portions 110, as illustrated passing through respective eyes 118 affixed, for example, to the bottom flap portions 110, such that when the bag 100 is suspended from the strap 112 and the bottom flap portions 110 are drawn taut against the endwalls 108, the tie-downs 116 are drawn through the eyes 118, thereby drawing the top flap portions 114 between the endwalls 108 and the bottom flap portions 110. The eyes 118 may be affixed to the bottom flap portions 110 at a junction where the respective endwalls 108 close the ends of the respective sidewalls 102. The eyes 118 may be so affixed by tether, and as illustrated, may retractably extend through a gap in the stitching between the centre portion of the respective bottom flap portions 110 and the adjacent endwalls 108.

Figure 18:
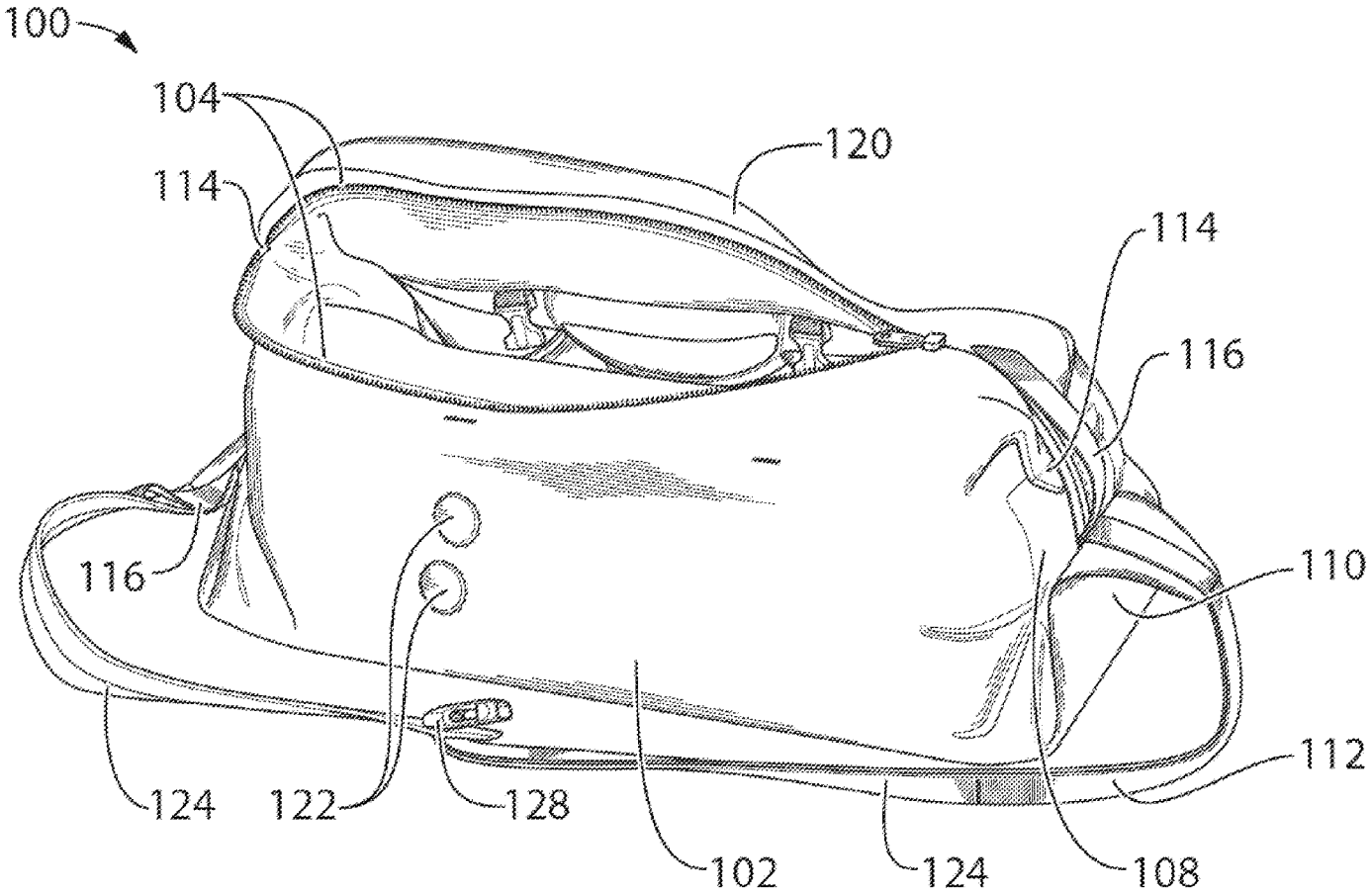
FIG. 18 is a top, front, right oblique view of the bag of FIG. 1 in an open configuration, with the bottom flap portion relaxed and the top flap portion relaxed.
Figure 19:
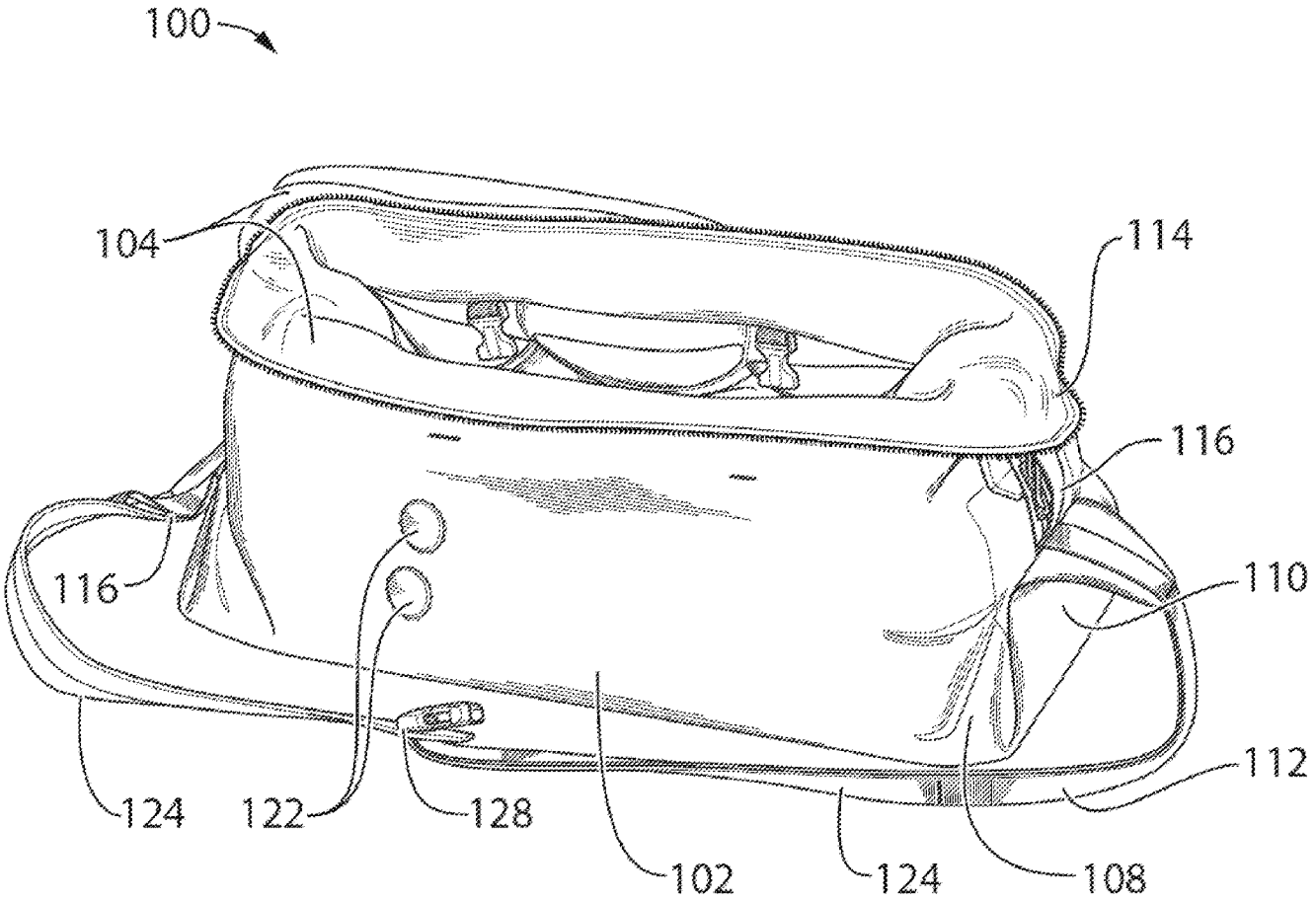
FIG. 19 is a top, front, right oblique view of the bag of FIG. 1 in a wide open configuration, with the bottom flap portion relaxed and the top flap portion extended wide open.

Alternatively, one of the tie-downs 116 may extend between one of the top flap portions 114 and a portion of the strap 112 adjacent the respective bottom flap portion 110 (see for example FIGS. 18-19). The tie-downs 116 may extend from the top flap portions 114 from the first complementary couplers 106, as illustrated at the end of the first complementary couplers 106.

As illustrated, the bag 100 may further include a cover 120 to at least partially cover the first complementary coupler 106. In this regard, the cover 120 may be permanently fastened to the sidewall 102 proximate to one of the opposing edges 104, and releasably fastened to the sidewall 102 proximate to the other one of the opposing edges 104, for example with a second complementary coupler 122. As illustrated, the second complementary coupler 122 may have more than one fastening position, to accommodate varying degrees of fullness of the bag 100. As illustrated, the second complementary coupler may be magnetic.

The strap 112 may be formed as two sections 124, as illustrated each of the respective sections 124 being approximately the length of the bag 100 and having a free end and a fixed end affixed to one of the respective bottom flap portions 110. The free end of one of the sections 124 may have a receptacle 126 for slidably receiving the free end of the other one of the sections 124, which received free end may have a termination 128 adapted to resist removal of the received free end from the receptacle 126, so that the two sections 124 function as a complete strap 112 from which to suspend the bag 100, for example for carriage or storage. As illustrated, at least one of the sections 124 may be doubled, for example to provide extra strength or adjustability.

As illustrated, the termination 128 may be part of a third complementary coupler 130 to secure the other one of the sections 124 to both of the bottom flap portions 110, thereby further cinching the bag 100 and converting the strap 112 into a reinforced handle 132 configuration.

(b) Operation of Specific Embodiments

With reference to figures, the operation of these specific embodiments of the invention will now be described.

FIGS. 1-9 show the bag 100 in a closed configuration, with:

- the first complementary coupler 106 closing opposing edges 104 of the sidewall 102,
- the cover 120 covering at least a portion of the first complementary coupler 106 and held in place by the second complementary coupler 122,
- the strap 112 cinched tight in handle 132 configuration, with the two sections 124 reinforcing each other, essentially doubled-up, the third complementary coupler 130 securing the other one of the sections 124 to both of the bottom flap portions 110,
- the bottom flap portions 110 being drawn against the endwalls 108 by the strap 112, and
- the respective top flap portions 114 being drawn between the endwalls 108 and the bottom flap portions 110 by the tie-downs 116.

So configured, the bag 100 is secure for carriage.

As best seen in FIGS. 8-11, if the user prefers a shoulder strap 112 to a handle 132, the third complementary coupler 130 can be disengaged and the two sections 124 of the strap 112 allowed to slide with respect to each other until the termination 128 urges against the receptacle 126 to resist separation of the sections 124.

As best seen in FIGS. 12-19, to open the bag 100, the user may disengage the second complementary coupler 122 and retract the cover 120 to expose the first complementary coupler 106. Releasing tension on the strap 112 will relax the respective bottom flap portions 110, and hence the tie-downs 116 and the respective top flap portions 114, permitting wide access to the bag 100 enclosure when the first complementary coupler 106 is disengaged.

To load, close and carry or store the bag 100, the user would reverse these steps.

(c) Description Summary

Thus, it will be seen from the foregoing embodiments and examples that there has been described a way to provide an adjustable strap system for both carrying and closing a bag.

While specific embodiments of the invention have been described and illustrated, such embodiments should be considered illustrative of the invention only and not as limiting the invention. It will be understood by those skilled in the art that various changes, modifications and substitutions can be made to the foregoing embodiments without departing from the principle and scope of the invention expressed in the claims made herein.

The invention claimed is:

1. An apparatus comprising:

a. a bag comprising a first end, a second end opposite the first end, and a sidewall extending between the first end and the second end, the sidewall comprising:
   i. a first top flap portion that can extend beyond and overlap the first end;
   ii. a second top flap portion that can extend beyond and overlap the second end; and
   iii. a closable opening extending a length of the sidewall and from the first top flap portion to the second top flap portion;

b. a first bottom flap portion extending from the deformable container and beyond the first end, the first bottom flap portion comprising a first bottom flap portion eye;

c. a second bottom flap portion extending from the deformable container and beyond the second end, the second bottom flap portion comprising a second bottom flap portion eye;

d. a strap extendable through the first bottom flap portion eye, and the second bottom flap portion eye, such that when the apparatus is suspended from the strap:
   i. the first top flap portion is drawn towards the first bottom flap portion and overlaps the first end;
   ii. the second top flap portion is drawn towards the second bottom flap portion and overlaps the second end;
   iii. the first bottom flap portion is drawn towards and overlaps the first top flap portion and the first end; and
   iv. the second bottom flap portion is drawn towards and overlaps the second top flap portion and the second end.

2. An apparatus as claimed in claim 1, wherein the first bottom flap portion extends from the first end and the second bottom flap portion extends from the second end.

3. An apparatus as claimed in claim 2, wherein a portion of the first bottom flap portion is coupled to the surface of the first end, and wherein a portion of the second bottom flap portion is coupled to the surface of the second end.

4. An apparatus as claimed in claim 1, further comprising a cover adapted to at least partially cover the closable opening.

5. An apparatus as claimed in claim 4, wherein the cover is permanently fastened to the sidewall at a first end of the cover and releasably fastened, by a coupling means, to the sidewall at a second end of the cover.

6. An apparatus as claimed in claim5, wherein the coupling means has more than one fastening position.

7. An apparatus as claimed in claim 1, wherein the strap comprises a first section and a second section.

8. An apparatus as claimed in claim 7, wherein each of the first section and the second section of the strap can traverse the length of the apparatus, each of the first section and the second section having a free end and a fixed end, the fixed end of the first section being affixed to the first bottom flap portion, the fixed end of the second section being affixed to the second bottom flap portion.

9. An apparatus as claimed in claim 8, wherein the free end of the first section of the strap has a receptacle for slidably receiving the free end of the second section of the strap, the free end of the second section has having a termination adapted to resist removal of the free end of the second section from the receptacle.

10. An apparatus as claimed in claim 9, wherein the first section and the second section of the strap can overlap one another.

11. An apparatus as claimed in claim 10, wherein the termination of the second section is adapted to receive a coupling means located at the first bottom flap portion, thereby converting the strap into a reinforced handle configuration with the first section and the second section of the strap overlapping one another.

12. The apparatus as claimed in claim 3, wherein a first orifice is formed by coupling the portion of the first bottom flap portion to the surface of the first end, and wherein the strap extends through the first orifice.

13. The apparatus as claimed in claim 12, wherein a second orifice is formed by coupling the portion of the second bottom flap portion to the surface of the second end, and wherein the strap extends through the second orifice.

* * * * *